US006220349B1

(12) United States Patent
Vargus et al.

(10) Patent No.: US 6,220,349 B1
(45) Date of Patent: Apr. 24, 2001

(54) LOW PRESSURE, HIGH TEMPERATURE COMPOSITE BRIDGE PLUG

(75) Inventors: Gregory W. Vargus; Donald F. Hushbeck; Kevin T. Berscheidt; Donny W. Winslow, all of Duncan; Donald R. Smith, Wilson; Thomas W. Hawkins, Marlow, all of OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/311,458

(22) Filed: May 13, 1999

(51) Int. Cl.[7] ..... E21B 33/129
(52) U.S. Cl. ..... 166/138; 166/217
(58) Field of Search ..... 166/137, 138, 166/209, 210, 211, 215, 216, 217, 134

(56) References Cited

U.S. PATENT DOCUMENTS

| | | | |
|---|---|---|---|
| 1,648,377 | | 11/1927 | Crowell . |
| 2,043,225 | | 6/1936 | Armentrout et al. . |
| 2,084,611 | | 6/1937 | Crickmer . |
| 2,155,129 | | 4/1939 | Hall et al. . |
| 2,205,119 | | 6/1940 | Hall et al. . |
| 2,331,185 | | 10/1943 | Gordy . |
| 2,589,506 | | 3/1952 | Morrisett . |
| 2,778,430 | | 1/1957 | Baker . |
| 2,806,536 | | 9/1957 | Baker et al. . |
| 3,055,424 | | 9/1962 | Allen . |
| 3,529,667 | | 9/1970 | Malone . |
| 3,710,862 | | 1/1973 | Young et al. . |
| 3,910,348 | | 10/1975 | Pitts . |
| 4,067,358 | | 1/1978 | Streich . |
| 4,151,875 | | 5/1979 | Sullaway . |
| 4,300,631 | | 11/1981 | Sainato et al. . |
| 4,393,929 | * | 7/1983 | Akkerman ..... 166/134 |
| 4,440,223 | * | 4/1984 | Akkerman ..... 166/217 |
| 4,520,870 | | 6/1985 | Pringle . |
| 4,708,202 | | 11/1987 | Sukup et al. . |
| 4,784,226 | | 11/1988 | Wyatt . |
| 4,834,184 | | 5/1989 | Streich et al. . |
| 4,858,687 | | 8/1989 | Watson et al. . |
| 4,977,958 | | 12/1990 | Miller . |
| 5,086,839 | * | 2/1992 | Setterberg, Jr. et al. ..... 166/138 |
| 5,131,468 | * | 7/1992 | Lane et al. ..... 166/120 |
| 5,224,540 | | 7/1993 | Streich et al. . |
| 5,271,468 | | 12/1993 | Streich et al. . |
| 5,390,737 | | 2/1995 | Jacobi et al. . |

OTHER PUBLICATIONS

Halliburton Services Sales & Service Catalog No. 43 (1985).

* cited by examiner

*Primary Examiner*—Frank Tsay
(74) *Attorney, Agent, or Firm*—Robert A. Kent; Neal R. Kennedy

(57) ABSTRACT

A low pressure, high temperature composite bridge plug. The bridge plug comprises a mandrel with a plurality of slips disposed therearound. A wedge is initially attached to said mandrel and in planar contact with the slips for forcing the slips radially outwardly into gripping engagement with a wellbore. An elastomeric sealing element is disposed on the mandrel and compressed between the wedge and a shoulder on the mandrel to expand the packing element radially outward into sealing engagement with the wellbore. A plurality of ratchets retained in a ratchet body grippingly engage the mandrel to prevent the plug from unsetting. The mandrel, slips, wedge and ratchet body are preferably made of non-metallic, composite materials for easy drilling.

47 Claims, 1 Drawing Sheet

LOW PRESSURE, HIGH TEMPERATURE COMPOSITE BRIDGE PLUG

BACKGROUND OF THE INVENTION

1. Field of the Invention

This invention relates to downhole tools for use in high temperature wells, and more particularly, to a high temperature bridge plug made primarily of non-metallic composite materials.

2. Description of the Prior Art

In the drilling or reworking of oil wells, a great variety of downhole tools are used. For example, but not by way of limitation, it is often desirable to seal tubing or other pipe in the casing of the well, such as when it is desired to pump cement or other slurry down tubing and force the slurry out into a formation. It then becomes necessary to seal the tubing with respect to the well casing and to prevent the fluid pressure of the slurry from lifting the tubing out of the well. Packers and bridge plugs designed for these general purposes are well known in the art.

When it is desired to remove such downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. Milling is a relatively slow process, but it can be used on packers or bridge plugs having relatively hard components such as erosion-resistant hard steel. One such packer is disclosed in U.S. Pat. No. 4,151,875 to Sullaway, assigned to the assignee of the present invention and sold under the trademark EZ DISPOSAL packer. Other downhole tools in addition to packers and bridge plugs may also be drilled out.

In drilling, a drill bit is used to cut and grind up the components of the downhole tool to remove it from the wellbore. This is a much faster operation than milling, but requires the tool to be made of materials which can be accommodated by the drill bit. Soft and medium hardness cast iron have been used on the pressure-bearing components, along with some brass and aluminum items. Packers of this type include the Halliburton EZ DRILL® and EZ DRILL SV® squeeze packers.

The EZ DRILL® packer and bridge plug and the EZ DRILL SV® packer are designed for fast removal from the wellbore by either rotary or cable tool drilling methods. Many of the components in these drillable packing devices are locked together to prevent their spinning while being drilled, and the harder slips are grooved so that they can be broken up in small pieces. Typically, standard "tri-cone" rotary drill bits are used.

However, drilling out iron components requires certain techniques. Ideally, the operator employs variations in rotary speed and bit weight to help break up the metal parts and re-establish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to re-establish bit penetration. If this procedure is used, there are rarely problems. However, operators may not apply these techniques or even recognize when bit tracking has occurred. The result is that drilling times are greatly increased because the bit merely wears into the surface of the downhole tool rather than cutting into it to break it up.

While cast iron components may be necessary for the high pressures and temperatures for which they are designed, it has been determined that many wells experience pressures less than 10,000 psi and temperatures less than 425° F. Thus, the heavy-duty metal construction of some previous downhole tools, such as packers and bridge plugs described above, is not necessary for many applications.

For such well conditions, tools have been designed wherein at least some of the components, including slips and pressure-bearing components, are made at least partially of non-metallic materials, such as engineering-grade plastics. Such tools are shown in U.S. Pat. Nos. 5,271,468, 5,224,540, and 5,390,737, assigned to the assignee of the present invention. These tools are sold under the trademark FAS DRILL®. The plastic components in these tools are much more easily drilled than cast iron, and new drilling methods may be employed which use alternative drill bits such as polycrystalline diamond compact bits, or the like, rather than standard tri-cone bits.

These prior tools using non-metallic components utilize two sets of slips, one on each side of the packing elements to lock the tool in the wellbore and prevent it from unsetting. This is particularly helpful in high-pressure situations to keep the tool from being undesirably moved in the wellbore. However, not all well conditions have these pressure levels, and the present invention is designed to address such less severe well conditions. The present invention utilizes a single set of slips to hold the tool in the wellbore while a plurality of ratchets keep the tool from unsetting. This results in a cost reduction compared to current plugs and packers.

SUMMARY OF THE INVENTION

The present invention may be described as a packing apparatus for use in a wellbore and comprising a mandrel, a packing element disposed on the mandrel for sealing engagement with the wellbore when in a sealing position, a wedge disposed on the mandrel and having a wedge tapered surface thereon, a slip disposed on the mandrel for locking engagement with the wellbore when the packing element is in the sealing position and having a slip tapered surface engaging the wedge tapered surface, a ratchet body disposed on the mandrel and defining a ratchet cavity therein, and a ratchet disposed in the ratchet cavity and having teeth thereon adapted for locking engagement with the mandrel. Preferably, the ratchet body, slips, wedge and mandrel are made of substantially non-metallic materials. The ratchet itself is preferably made of a metallic material.

In a preferred embodiment, the mandrel has a shoulder thereon adjacent to one side of the packing element, and the wedge is disposed on an opposite side of the packing element from the shoulder. The mandrel is relatively movable with respect to the wedge for longitudinally compressing the packing element and expanding it radially outwardly to the sealing position. The wedge tapered surface is on an opposite side of the wedge from the packing element.

The ratchet body is in constant contact with an end of the slip. This end of the slip is on an opposite side of the slip from the slip tapered surface. There is substantially no relative movement between the ratchet body and the slip in a longitudinal direction with respect to the mandrel.

The invention may also be described as a packing apparatus for use in a wellbore and comprising a mandrel, a packing element disposed on the mandrel for sealing engagement with the wellbore when in a sealing position, a wedge disposed on the mandrel and having a substantially planar wedge tapered surface thereon, and a slip disposed on the mandrel and having a substantially planar slip tapered surface thereon engaging the wedge tapered surface. Prior slips and wedges use curvilinear surfaces which, for non-metallic materials, have been found to sometimes bind and not work smoothly. The planar surface contact between the wedge and slip of the present invention avoids this binding problem.

Stated in another way, the present invention is a packing apparatus for use in a wellbore and comprising a mandrel, a packing element disposed on the mandrel for sealing engagement with the wellbore when in a sealing position, a wedge disposed on the mandrel and having a substantially planar wedge tapered surface thereon, a slip disposed on the mandrel and having a substantially planar slip tapered surface thereon engaging the wedge tapered surface, a ratchet body disposed on the mandrel and defining a ratchet cavity therein, and a ratchet disposed in the ratchet cavity and having teeth thereon adapted for locking engagement with the mandrel for holding the mandrel in a set position with respect to the packing element. The slip and wedge are made of non-metallic materials, and preferably, the ratchet body and mandrel are also made of non-metallic materials. The ratchet is metallic.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1A:
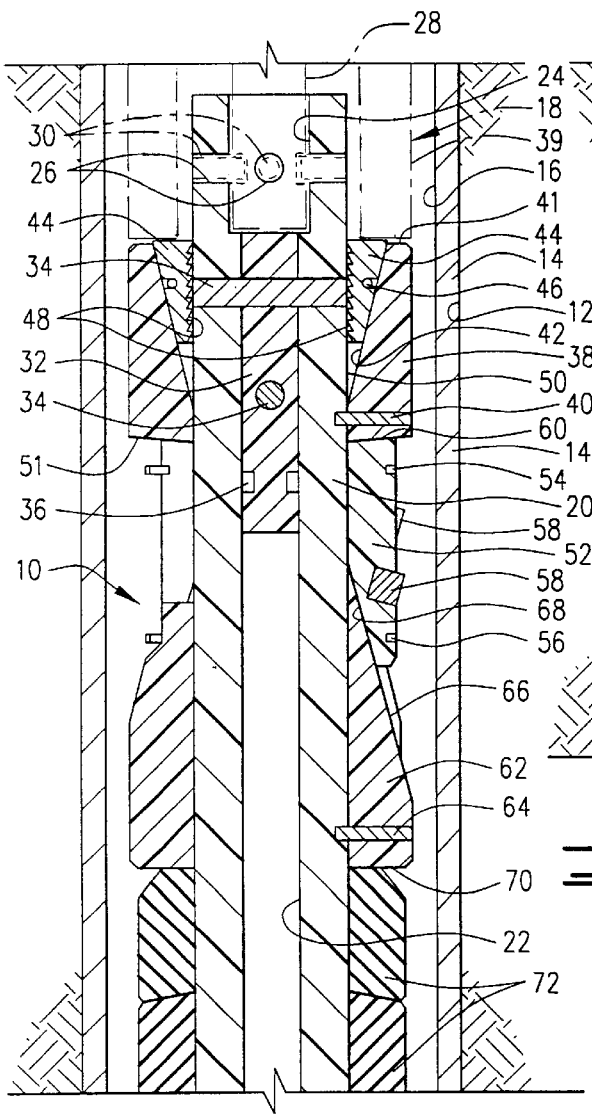
FIGS. 1A and 1B show a longitudinal cross section of the low pressure, high temperature composite bridge plug of the present invention as it is run into a wellbore.
Figure 1B:
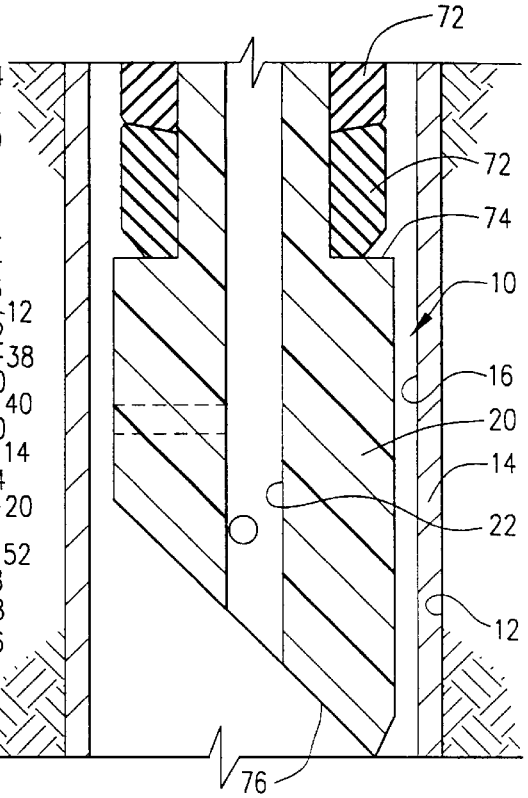
Figure 2:
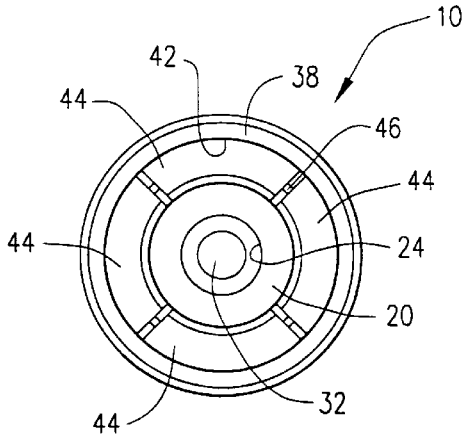
FIG. 2 is a top end view of the bridge plug.

Referring now to the drawings, and more particularly to FIGS. 1A and 1B, the low pressure, high temperature composite bridge plug of the present invention is shown and generally designated by the numeral 10. Apparatus 10 is designed to operate in a wellbore 12 having a casing 14 therein. Casing 14 has an inner surface 16.

Apparatus 10 is run into wellbore 12 on a setting tool 18 of a kind generally known in the art. Setting tool 18 may be an electric wireline tool, a slick line tool, a coiled tubing tool or a mechanical setting tool.

Apparatus 10 comprises a central mandrel 20 having a central opening 22 therein.

At the upper end of central opening 22 in mandrel 20 is an enlarged bore 24 intersected by four radially oriented holes 26.

Setting tool 18 has a rod portion 28 which is retained in bore 24 of mandrel 20 by four shear pins 30 which are disposed through holes 26.

In the illustrated embodiment, apparatus 10 is a bridge plug and has a mandrel plug 32 disposed in an upper portion of central opening 22. Mandrel plug 32 is held in place by pins 34. A sealing means, such as an O-ring 36, provides sealing engagement between mandrel plug 32 and mandrel 20. If the application requires fluid flow through apparatus 10, mandrel plug 32 and pins 34 are simply omitted so that fluid may flow through central opening 22 of mandrel 20.

A ratchet body 38 is disposed around the upper end of mandrel 20 and connected thereto by a pin 40. Setting tool 18 also has a setting sleeve 39 which engages ratchet body 38 at an upper end 41 thereof.

Ratchet body 38 defines a tapered or conical bore 42 therein. A plurality of ratchets 44 are disposed in conical bore 42 in ratchet body 38. Thus, conical bore 42 may also be described as a ratchet cavity 42. Ratchets 44 are loosely held together as a unit by a retainer ring 46. Each ratchet 44 has a plurality of radially inwardly oriented ratchet teeth 48 thereon. Ratchet teeth 48 are adapted for gripping and locking engagement with outer surface 50 of mandrel 20 when apparatus 10 is in a set position, as further described herein.

Ratchet body 38 has a lower surface 51 which extends radially and tapers slightly upwardly with respect to mandrel 20. Below ratchet body 38 are a plurality of slips 52 which are held together as a unit around mandrel 20 by an upper retainer ring 54 and a lower retainer ring 56. Each slip 52 has a plurality of hard buttons or inserts 58 molded therein which are adapted for gripping engagement with inner surface 16 of casing 14 when apparatus 10 is in a set position, as further described herein.

Upper ends 60 of slips 52 are tapered slightly to conform with lower end 51 of ratchet body 38. Upper end 60 of slips 52 are in constant contact with lower end 51 of ratchet body 38.

A wedge 62 is shearably attached to mandrel 20 by a shear pin 64. Wedge 62 has a plurality of tapered flat or planar surfaces 66, each planar surface corresponding to a slip 52. Tapered planar surfaces 66 on wedge 62 extend upwardly into slips 52 and engage a corresponding tapered flat or planar surface 68 on the lower inside of each slip 52. As will be further described herein, the planar contact between surfaces 68 on slips 52 with surfaces 66 on wedge 62 prevents binding which can be a problem on prior art curvilinear slip and wedge surfaces, at least when the components are made of non-metallic materials.

Below lower end 70 of wedge 62 is an elastomeric packer element or seal 72.

Referring now also to FIG. 1B, packer element 72 is supported on its lower end by an upwardly facing shoulder 74 on mandrel 20. Mandrel 20 has a slanted lower end 76 which helps guide apparatus 10 past small obstructions in wellbore 14 as apparatus 10 is run into the well on setting tool 18.

Apparatus 10 is designed to be a low pressure, high temperature composite bridge plug, and mandrel 20, mandrel plug 32, ratchet body 38, slips 52 (except for inserts 58), and wedge 62 are preferably made of composite materials such as engineered plastics. Such materials allow for apparatus 10 to be easily drilled out of wellbore 12 when no longer required, as does the soft elastomeric material of packer element 72. Ratchets 44 are preferably metallic, but are small enough that they do not present drilling problems.

In the preferred embodiment, the materials have an operating temperature of up to 350° F. The bridge plug design will hold pressure up to 2,000 to 3,000 psi from below the plug. This allows for cement to be placed on top of the plug.

OPERATION OF THE INVENTION

In operation, apparatus 10 is connected to setting tool 18, as previously described, and run into casing 14 in wellbore 12 to the desired location. Setting tool 18 is actuated to cause rod 28 to pull upwardly on mandrel 20 while setting sleeve 39 holds ratchet body 38 and ratchet 44 in place and prevents the ratchet body and ratchets from moving. This upward pull on mandrel 20 forces wedge 62 upwardly inside slips 52. The tapered, planar contact between surfaces 66 on wedge 62 and surfaces 66 on slips 52 cause the slips to be moved smoothly radially outwardly, breaking or disengaging upper retainer ring 54 and lower retainer ring 56. Eventually, slips 52 are forced outwardly far enough that inserts 58 grippingly engage inner surface 16 of casing 14 adjacent thereto which acts to hold apparatus 10 in place in the wellbore.

As slips 52 are thus moved radially outwardly, it will be seen that upper ends 60 of the slips slide along lower end 51 of ratchet body 38. Although these surfaces are slightly tapered as previously described, there is substantially no relative longitudinal movement between the slips and ratchet body.

Once slips 52 are set, wedge 62 can no longer move upwardly with respect to the slips, and further upward pull on mandrel 20 results in shearing of shear pin 64 so that the mandrel is pulled upwardly with respect to wedge 62. It will be seen by those skilled in the art that shoulder 74 on mandrel 20 is thus moved upwardly toward lower end 70 of wedge 62 which compresses packer element 72, expanding it radially outwardly into sealing engagement with inner surface 16 of casing 14.

Once apparatus 10 has thus been set into gripping and sealing engagement with casing 14 in wellbore 12, actuation of setting tool 18 is stopped. The elastomeric material of packer element 72 will bias mandrel 20 downwardly unless the mandrel is otherwise held in place. This is accomplished by gripping engagement of teeth 48 in ratchets 44 which hold mandrel 20 to keep it from sliding back down. Because of the wedging action of ratchets 44 in conical bore 42 and ratchet body 38, the greater the downward force applied to mandrel 20, the greater the gripping engagement of teeth 48 on outer surface 50 of the mandrel.

Once packer element 72 is sufficiently compressed to expand outwardly into sealing engagement with inner surface 16 of casing 14, further loading on mandrel 22 by rod 28 of setting tool 18 will shear shear pins 30 which releases the setting tool from apparatus 10 so that the setting tool may be removed from wellbore 12, leaving apparatus 10 therein.

As previously discussed, the composite materials of most of the components of apparatus 10 allow it to be quickly and easily drilled out of wellbore 14 when it is no longer of use.

It will be seen, therefore, that the low pressure, high temperature composite bridge plug of the present invention is well adapted to carry out the ends and advantages mentioned as well as those inherent therein. While the presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A packing apparatus for use in a wellbore, said apparatus comprising:

a mandrel made of a substantially non-metallic material;

a packing element disposed on said mandrel for sealing engagement with the wellbore when in a sealing position;

a wedge disposed on said mandrel;

a single set of slips disposed around said mandrel for locking engagement with the wellbore when said packing element is in said sealing position each slip having a slip tapered surface engaging said wedge;

a ratchet body disposed on said mandrel and defining a ratchet cavity therein; and a ratchet disposed in said ratchet cavity and having teeth thereon adapted for locking engagement with said wellbore.

2. The apparatus of claim 1 wherein said ratchet body is made of a non-metallic material.

3. The apparatus of claim 1 wherein said slips and wedge are made of a non-metallic material.

4. The apparatus of claim 1 wherein said ratchet is made of a metallic material.

5. The apparatus of claim 1 wherein:

said wedge has a plurality of wedge tapered surfaces thereon, each wedge tapered surface being engaged by a corresponding one of said slip tapered surfaces: and said slip and wedge tapered surfaces are substantially planar.

6. The apparatus of claim 5 wherein said wedge tapered surfaces are on an opposite side of said wedge from said packing element.

7. The apparatus of claim 1 wherein:

said mandrel has a shoulder thereon adjacent to one side of said packing element; and said wedge is disposed on an opposite side of said packing element from said shoulder, said mandrel being relatively movable with respect to said wedge for longitudinally compressing said packing element and expanding it radially outwardly to said sealing position.

8. A packing apparatus for use in a wellbore, said apparatus comprising:

a mandrel;

a packing element disposed on said mandrel for sealing engagement with the wellbore when in a sealing position;

a wedge disposed on said mandrel and having a plurality of substantially planar wedge tapered surfaces thereon; and a single set of slips disposed around said mandrel each slip having a substantially planar slip tapered surface thereon engaging a corresponding one of said wedge tapered surfaces.

9. The apparatus of claim 8 further comprising:

a ratchet body disposed on said mandrel and defining a ratchet cavity therein; and a ratchet disposed in said ratchet cavity and having teeth thereon adapted for locking engagement with said mandrel for holding said mandrel in a set position with respect to said packing element.

10. The apparatus of claim 9 wherein said ratchet body is made of a non-metallic material.

11. The apparatus of claim 9 wherein said ratchet is made of a metallic material.

12. The apparatus of claim 8 wherein said slips and wedge are made of a non-metallic material.

13. The apparatus of claim 8 wherein said mandrel is made of a non-metallic material.

14. The apparatus of claim 8 wherein:

said mandrel has a shoulder thereon adjacent to one side of said packing element; and said wedge is disposed on an opposite side of said packing element from said shoulder, said mandrel being relatively movable with respect to said wedge for longitudinally compressing said packing element and expanding it radially outwardly to said sealing position.

15. The apparatus of claim 8 wherein said wedge tapered surfaces are on an opposite side of said wedge from said packing element.

16. A packing apparatus for use in a wellbore, said apparatus comprising:

a mandrel;

a packing element disposed on said mandrel for sealing engagement with the wellbore when in a sealing position;

a wedge disposed on said mandrel and having a plurality of substantially planar wedge tapered surfaces thereon, said wedge being made of a non-metallic material;

a single set of slips disposed around said mandrel each slip having a substantially planar slip tapered surface thereon engaging a corresponding wedge tapered surface, said slips being made of a non-metallic material;

a ratchet body disposed on said mandrel and defining a ratchet cavity therein; and a ratchet disposed in said ratchet cavity and having teeth thereon adapted for locking engagement with said mandrel for holding said mandrel in a set position with respect to said packing element.

17. The apparatus of claim 16 wherein said ratchet body is made of a non-metallic material.

18. The apparatus of claim 16 wherein said ratchet is made of a metallic material.

19. The apparatus of claim 16 wherein said mandrel is made of a non-metallic material.

20. The apparatus of claim 16 wherein:

said mandrel has a shoulder thereon adjacent to one side of said packing element; and said wedge is disposed on an opposite side of said packing element from said shoulder, said wedge and mandrel being relatively movable for longitudinally compressing said packing element and expanding it radially outwardly to said sealing position.

21. The apparatus of claim 20 wherein said wedge tapered surfaces are on an opposite side of said wedge from said packing element.

22. A packing apparatus for use in a wellbore, said apparatus comprising:

a mandrel made of a substantially non-metallic material;

a packing element disposed on said mandrel for sealing engagement with the wellbore when in a sealing position;

a wedge disposed on said mandrel and having a wedge tapered surface thereon;

a slip disposed on said mandrel for locking engagement with the wellbore when said packing element is in said sealing position and having a slip tapered surface engaging said wedge tapered surface;

a ratchet body disposed on said mandrel and defining a ratchet cavity therein, said ratchet cavity being in constant contact with an end of said slip; and a ratchet disposed in said ratchet cavity and having teeth thereon adapted for locking engagement with said mandrel.

23. The apparatus of claim 22 wherein said end of said slip is on an opposite side of said slip from said slip tapered surface.

24. The apparatus of claim 22 wherein there is substantially no relative movement between said ratchet body and said slip in a longitudinal direction with respect to said mandrel.

25. The apparatus of claim 21 wherein said ratchet body is made of a non-metallic material.

26. The apparatus of claim 21 wherein said slip and wedge are made of a non-metallic material.

27. The apparatus of claim 22 wherein said ratchet is made of a metallic material.

28. The apparatus of claim 22 wherein said slip and wedge tapered surfaces are substantially planar.

29. The apparatus of claim 22 wherein:

said mandrel has a shoulder thereon adjacent to one side of said packing element; and said wedge is disposed on an opposite side of said packing element from said shoulder, said mandrel being relatively moveable with respect to said wedge for longitudinally compressing said packing element and expanding it radially outwardly to said sealing position.

30. The apparatus of claim 29 wherein said wedge tapered surface is on an opposite side of said wedge from said packing element.

31. A packing apparatus for use in a wellbore, said apparatus comprising:

a mandrel;

a packing element disposed on said mandrel for sealing engagement with the wellbore when in a sealing position;

a wedge disposed on said mandrel and having a substantially planar wedge tapered surface thereon;

a slip disposed on said mandrel and having a substantially planar slip tapered surface thereon engaging said wedge tapered surface;

a ratchet body disposed on said mandrel and defining a ratchet cavity therein, said ratchet body being always in contact with an end of said slip; and a ratchet disposed in said ratchet cavity and having teeth thereon adapted for locking engagement with said mandrel for holding said mandrel in a set position with respect to said packing element.

32. The apparatus of claim 31 wherein said end of said slip is on an opposite side of said slip from said slip tapered surface.

33. The apparatus of claim 31 wherein there is substantially no relative movement between said ratchet body and said slip in a longitudinal direction with respect to said mandrel.

34. The apparatus of claim 31 wherein said ratchet body is made of a non-metallic material.

35. The apparatus of claim 31 wherein said ratchet is made of a metallic material.

36. The apparatus of claim 31 wherein said slip and wedge are made of a non-metallic material.

37. The apparatus of claim 31 wherein said mandrel is made of a non-metallic material.

38. The apparatus of claim 31 wherein:

said mandrel has a shoulder thereon adjacent to one side of said packing element; and said wedge is disposed on an opposite side of said packing element from said shoulder, said mandrel being relatively moveable with respect to said wedge for longitudinally compressing said packing element and expanding it radially outwardly to said sealing position.

39. The apparatus of claim 38 wherein said wedge tapered surface is on an opposite side of said wedge from said packing element.

40. The apparatus of claim 31 wherein said ratchet body is made of a non-metallic material.

41. The apparatus of claim 31 wherein said ratchet is made of a metallic material.

42. The apparatus of claim 31 wherein said mandrel is made of a non-metallic material.

43. The apparatus of claim 31 wherein:

said mandrel has a shoulder thereon adjacent to one side of said packing element; and said wedge is disposed on an opposite side of said packing element from said shoulder, said wedge and mandrel being relatively moveable for longitudinally compressing said packing element and expanding it radially outwardly to said sealing position.

44. The apparatus of claim 43 wherein said wedge tapered surface is on an opposite side of said wedge from said packing element.

45. A packing apparatus for use in a wellbore, said apparatus comprising:

a mandrel;

a packing element disposed on said mandrel for sealing engagement with a wellbore when in a sealing position;

a wedge disposed on said mandrel and having a substantially planar wedge tapered surface thereon, said wedge being made of a non-metallic material;

a slip disposed on said mandrel and having a substantially planar slip tapered surface thereon engaging said wedge tapered surface, said slip being made of a non-metallic material;

a ratchet body disposed on said mandrel and defining a ratchet cavity therein, said ratchet body being always in contact with an end of said slip; and a ratchet disposed in said ratchet cavity and having teeth thereon adapted for locking engagement with said mandrel for holding said mandrel in a set position with respect to said packing element.

46. The apparatus of claim 45 wherein said end of said slip is on an opposite side of said slip from said slip tapered surface.

47. The apparatus of claim 45 wherein there is substantially no relative movement between said ratchet body and said slip in a longitudinal direction with respect to said mandrel.

* * * * *